US009122201B2

(12) United States Patent
Wegman

(10) Patent No.: US 9,122,201 B2
(45) Date of Patent: Sep. 1, 2015

(54) METHOD AND APPARATUS FOR REDUCING RESIDUAL TONER IN A ROTATING CONTAINER

(71) Applicant: XEROX CORPORATION, Norwalk, CT (US)

(72) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 64 days.

(21) Appl. No.: 13/797,714

(22) Filed: Mar. 12, 2013

(65) Prior Publication Data

US 2014/0270855 A1 Sep. 18, 2014

(51) Int. Cl.
*G03G 15/08* (2006.01)

(52) U.S. Cl.
CPC ..... *G03G 15/0867* (2013.01)

(58) Field of Classification Search
USPC ..... 399/107, 110, 119, 120, 252–263; 222/DIG. 1
See application file for complete search history.

(56) References Cited

U.S. PATENT DOCUMENTS

| | | | | |
|---|---|---|---|---|
| 4,739,907 | A | 4/1988 | Gallant | |
| 4,943,830 | A | 7/1990 | Sulenski | |
| 5,722,014 | A * | 2/1998 | Fike | 399/119 |
| 6,665,505 | B2 * | 12/2003 | Meetze et al. | 399/106 |
| 7,088,930 | B2 | 8/2006 | Mimura | |
| 7,778,578 | B2 * | 8/2010 | Takuwa | 399/262 |
| 7,881,642 | B2 | 2/2011 | Walsh et al. | |

* cited by examiner

*Primary Examiner* — Hoan Tran
(74) *Attorney, Agent, or Firm* — Ronald E. Prass, Jr.; Prass LLP

(57) ABSTRACT

An approach is provided for reducing an amount of residual toner remaining in a rotating container. The approach involves rotating a rotatable vessel configured to contain a toner. The rotatable vessel includes a body section having a substantially round cross-section, a first end at one axial end of the body section, a second end axially distal the first end, and helical features on an internal surface of the body section configured to transport the toner in an axial direction between the first end and the second end as the vessel is rotated. The approach also involves causing, at least in part, at least a portion of the toner to be agitated by an insert configured to tumble and rotate within an inside portion of the rotatable vessel as the rotatable vessel rotates.

14 Claims, 6 Drawing Sheets

METHOD AND APPARATUS FOR REDUCING RESIDUAL TONER IN A ROTATING CONTAINER

RELATED APPLICATIONS

This application is related to the following co-pending applications, each of which is hereby incorporated herein by reference in its entirety: U.S. patent application Ser. No. 13/691,693, filed Nov. 30, 2012, entitled "SYSTEMS AND METHODS FOR FACILITATING ADVANCED TONER DISPENSING FROM ROTATING TONER CARTRIDGE COMPONENTS," by Gerardo Leute, U.S. patent application Ser. No. 13/797,969, filed Mar. 12, 2013, entitled "METHOD AND APPARATUS FOR REDUCING RESIDUAL TONER IN A ROTATING CONTAINER," by Ian Harpur et al., and U.S. patent application Ser. No. 13/797,879, filed Mar. 12, 2013, entitled "METHOD AND APPARATUS FOR REDUCING RESIDUAL TONER IN A ROTATING CONTAINER," by Paul M. Wegman.

FIELD OF DISCLOSURE

This disclosure relates to an apparatus, method and system for reducing residual toner in a rotating container useful in printing.

BACKGROUND

Some image forming devices use powdered toner as the marking material for image forming on image receiving substrates. The term "toner" generally refers to a powder used as the marking material in image forming devices such as xerographic image forming devices, laser printers and photocopiers to form printed text and images on image receiving substrates.

Toner is typically packaged in containers of differing sizes, shapes and compositions. The containers may be generically referred to as "toner cartridges." Toner cartridges are often closed containers in which the toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device Toner cartridge manufacturers are continually challenged with maximizing toner cartridge life expectancy and reducing waste. As a toner cartridge is used, an image forming device may indicate that a toner cartridge is empty, or a user may determine that a toner cartridge is empty based on print quality. But, residual amounts of usable toner may still remain in the toner cartridge despite a determination that a toner cartridge is empty.

SUMMARY

Therefore, there is a need for an approach to reduce residual toner in a rotating container useful in printing.

According to one embodiment, an apparatus useful in printing comprises a rotatable vessel configured to contain a toner. The rotatable vessel comprises a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated. The apparatus also comprises an insert configured to tumble and rotate within an inside portion of the rotatable vessel and agitate the toner as the rotatable vessel rotates.

According to another embodiment, a method useful in printing comprises causing, at least in part, a rotatable vessel configured to contain a toner to rotate about an axis. The rotatable vessel comprises a body section having a substantially round cross-section, a first end at one axial end of the body section, a second end axially distal the first end, and helical features on an internal surface of the body section configured to transport the toner in an axial direction between the first end and the second end as the vessel is rotated. The method also comprises causing, at least in part, at least a portion of the toner to be agitated by an insert configured to tumble and rotate within an inside portion of the rotatable vessel as the rotatable vessel rotates.

According to another embodiment, an image forming device comprises an image marking device and at least one rotating toner delivery container. The at least one rotating toner deliver container comprises a rotatable vessel configured to contain a toner. The rotatable vessel comprising a body section having a substantially round cross-section, a first end at one axial end of the body section, a second end axially distal the first end, and helical features on an internal surface of the body section configured to transport at least a portion of the toner in an axial direction into the image marking device, the axial direction being between the first end and the second end as the rotatable vessel is rotated. The rotating toner delivery container also comprises an insert configured to tumble and rotate within an inside portion of the rotatable vessel and agitate the toner as the rotatable vessel rotates.

According to another embodiment, a method of filling a container with a toner material useful in printing comprises providing a vessel configured to contain a toner. The vessel comprises a body section having a substantially round cross-section, a first end at one axial end of the body section, a second end axially distal the first end, and helical features on an internal surface of the body section. The helical features are configured to transport the toner in an axial direction between the first end and the second end as the vessel is rotated by an image forming device. The method also comprises causing, at least in part, the vessel to be filled with the toner. The method further comprises causing, at least in part, an insert configured to agitate at least a portion of the toner to be input into the vessel, the insert being configured to tumble and rotate within an inside portion of the vessel as the vessel is rotated by the image forming device.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Examples of a method, apparatus, and system for reducing residual toner in a rotating container useful in printing are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

The systems and methods for reducing residual toner in a rotating container according to this disclosure will generally refer to this specific utility for those systems and methods. Exemplary embodiments described and depicted in this disclosure should not be interpreted as being specifically limited to any particular configuration of a rotating toner bottle, cartridge or dispenser, including a plastic or injection molded bottle, cartridge or dispenser. It should be recognized that advantageous use of a unique container configuration that may aid in, in use, emptying of a powdered substance from that container employing devices and methods such as those discussed in detail in this disclosure is contemplated.

As used herein, the term "toner" generally refers to a powdered material used as the marking material in image forming devices such as xerographic image forming devices, laser printers and photocopiers to form printed text and images on image receiving substrates.

As used herein, the term "toner cartridge" generally refers to a closed container in which toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device.

As used herein, the term "pitch" refers generally to a coil-to-coil spacing of at least a portion of a coiled wire-form or channel-to-channel spacing or protrusion-to-protrusion spacing of, for example, one or more helical features.

Figure 1:
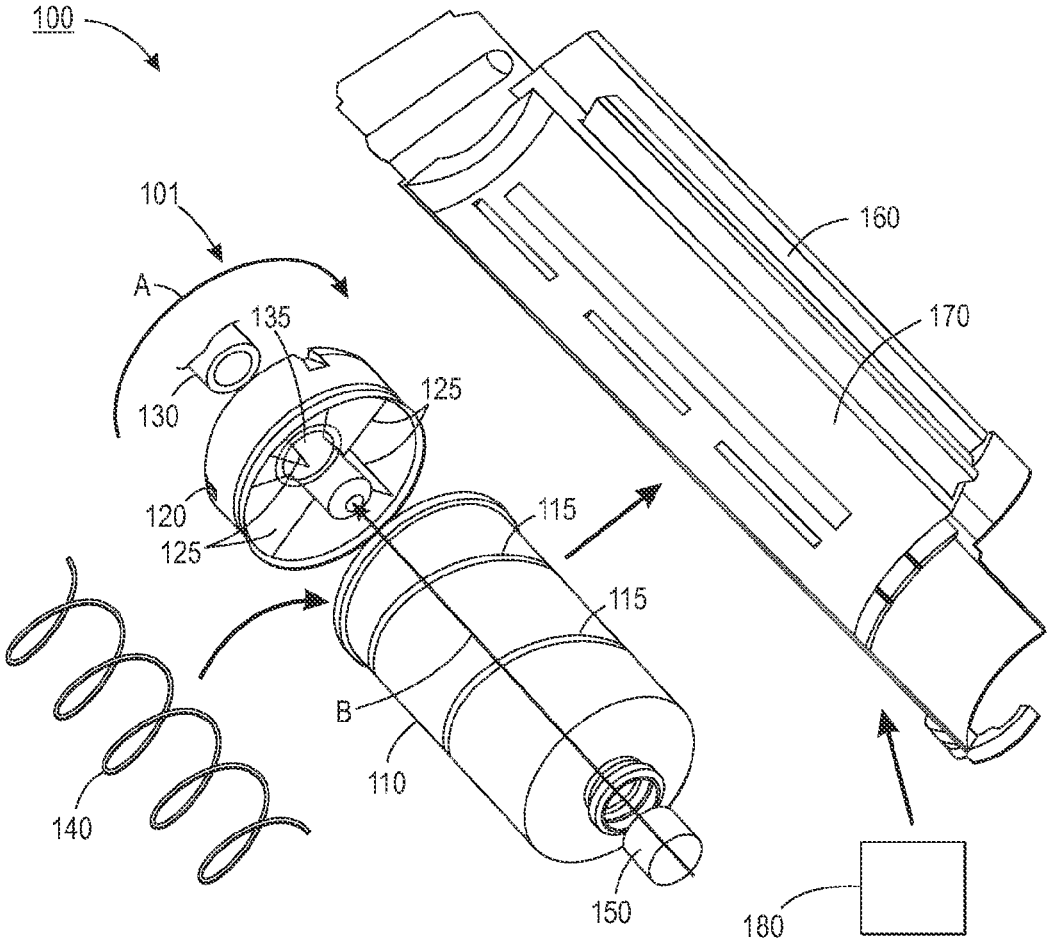
FIG. 1 is an exploded view of a system capable of reducing residual toner in a rotating container, according to one example embodiment.

FIG. 1 is a diagram of a system capable of reducing residual toner in a rotating container, according to one embodiment.

Certain image forming devices use powdered toner as the marking material for image forming on image receiving substrates. Toner is typically packaged in containers of differing sizes, shapes and compositions. These containers often include injection or blow molded container products. The containers may be generically referred to as "toner cartridges." Customers and/or end users need never interact directly with the toner itself.

Image forming devices today include monitoring capabilities for monitoring levels of all consumables, including toner. Upon an indication that any consumable, including toner in a particular toner cartridge, is nearly exhausted, the prudent customer or end-user will procure a replacement consumable component, in this case a toner cartridge, to have it at the ready. In this manner, when the image forming device advises the customer or end-user that the toner is exhausted, the customer or end user need only remove the exhausted component and replace it with a fresh, full component.

One particular configuration of toner cartridges are toner bottles that are generally circular in cross-sectional profile. These toner bottles are particularly configured to be rotated in the image forming device in which they are installed in a manner that causes the toner material contained in the toner bottles to be transported axially toward an opening at dispensing end of the toner bottles. The toner material in the toner bottle is then driven by an internal auger formed from internal helical features toward an axially central opening in the dispensing end, through which the toner material is transported out of the toner bottle to the image forming device for use.

Dispensing all of the toner material from a toner bottle can be challenging. Some percentage of the toner material typically adheres to all of the internal surfaces of the toner bottle, as the material is made to flow axially along the walls of the toner bottle to a dispensing end (endcap) of the toner bottle, and then from the wall of the toner bottle in the endcap radially to a centrally-located dispense point.

It is actually an observed problem in these types of toner bottles that the toner material, in having to slide across the inside surface of the toner bottle to be transported to the discharge end of the toner bottle, may do so inefficiently. When less than all of the toner material slides across the inside surfaces of the bottle, less than all of the toner material will be available to be dispensed from the toner bottle. This results in the toner material remaining in the toner bottle when the toner bottle is seemingly empty, resulting in waste.

Experience has shown that an image forming device may indicate that all of the toner material in a particular toner bottle has been exhausted when some significant amount of usable residual toner material remains in the particular toner bottle. Simple visual inspection of the toner bottle by a customer or end-user during the process of removal and replacement may confirm that a reasonable amount of residual toner remains in the particular toner bottle. Simple manual agitation of the particular toner bottle may result in, for example, dislodging the residual toner adhering to all of the internal surfaces of the particular toner bottle to make the residual toner available for use. Manual agitation may be done, for example, by a user removing the toner bottle from the image forming device, holding and then physically shaking the toner bottle. If the apparently exhausted toner bottle is then reinserted in the image forming device, the residual toner material may be recovered and used by the image forming device.

In view of the above situation in conventional rotating toner bottle image forming devices, it would be advantageous to implement systems and methods by which to dislodge residual toner in the toner bottle so as to maximize toner cartridge life expectancy and thereby reduce both time and materials required for replacing an empty toner cartridge without the need to remove the toner bottle from the image forming device to perform manual agitation.

To address this problem, a system 100 of FIG. 1 introduces the capability to reduce residual toner in a rotating container. FIG. 1 illustrates an exploded view of the system 100 which may be used to supply a powdered material such as a toner to an image forming device. The system 100 generally comprises a toner bottle system 101, an insert 140 inside the toner bottle system 101, and a housing 160 in which the toner bottle system 101 is installed. As shown in FIG. 1, the toner bottle system 101 generally includes a container body 110 and an endcap 120. As will be described in greater detail below, the container body 110 and the endcap 120, which are typically combined as a closed vessel, each include physical features that promote flow of toner contained in the toner bottle system 101 to a dispense end that includes a dispensing opening 135, through the endcap 120.

The particular physical features are shown in exemplary manner in the depiction in FIG. 1. The container body 110 may include helical features 115 molded into the wall of the container body 110. The helical features 115 are intended to act as an auger to move or push the toner in the toner bottle system 101 in the axial direction "B" toward the dispense end, i.e., the endcap 120 and dispensing opening 135, as the toner bottle system 101 is rotated in direction "A."

When the toner arrives at the endcap 120 at the dispense end of the toner bottle system 101, there are a plurality of surfaces 125 in the endcap 120 of the toner bottle. This plurality of surfaces 125, again as the toner bottle system 101 is rotated in direction "A," may be used to lift the toner and allow the toner to slide toward the centrally located dispensing opening 135. Once the toner is in the dispensing opening 135, the toner is fed into an image forming material transport conduit 130 of the image forming device in which the system 100 is installed. The image forming material transport conduit 130 may be, for example, a part of an image marking device of the image forming device, or at least part of a transportation system for getting toner to the image marking device of the image forming device.

But, as discussed above, some residual toner may remain among the helical features 115 and any surfaces inside the container body 110. Accordingly, the system 100 also includes the insert 140. Though generally discussed with regard to a single insert 140, it should be understood that the toner bottle system 101 may include any number and combination of inserts 140 that may be of the same or different size, shape, or configuration.

The insert 140 is configured to agitate at least a portion of the toner contained by the toner bottle system 101 as the toner bottle system 101 is rotated by the image forming device. Agitating at least a portion of the toner contained by the toner bottle system may loosen any toner material that has been compacted or otherwise attached to the helical features 115 and/or internal surface of the container body 110.

In some embodiments, the insert 140 may directly agitate the toner through physical contact, cooperate with the helical features 115 and the internal surface of the container body 110 to agitate toner contained by the toner bottle system 101 and/or the insert 140 may cause a vibration inside the toner bottle system 101 to agitate the toner.

The insert 140 may take any form such as, but not limited to, a rod having a thickness and a length, a coiled wire-form having a length, a pitch, a wire thickness or diameter, and a coil diameter, a brush-type insert, or any combination thereof such as by having one or more portions that comprise any of a rod, a coiled wire-form and/or a brush.

According to various embodiments, the insert 140 may be allowed to freely tumble, rotate, roll, translate axially, and the like within an inner portion of the container body 110 constrained only by the container body 110 and the endcap 120, for example.

In other embodiments, the insert 140 may be constrained by at least one of a first end of the container body 110, a second end of the container body 110 axially distal the first end of the container body, and the endcap 120. In this example, the insert 140 may be allowed to tumble and agitate toner inside the container body 110, but may not be allowed to entirely translate axially as the toner bottle system 101 is rotated. It should be noted, however, that depending on form, the insert 140 may be allowed to flex and/or fluctuate in the axial direction as the toner bottle system 101 rotates while being constrained on at least one end.

The insert 140 comprises any material capable of agitating toner material such as any metal, polymer, ceramic, carbon fibre, wood, etc. In some embodiments, the insert 140 may be charged to repel toner material. In such a case, the insert 140 not only agitates the toner within the toner bottle system 101, but the insert 140 also ensures that little if any toner will adhere to the insert 140.

The insert 140 may be of any size. For example, in some embodiments, the insert 140 may have a length less than a length of the container body 110, in other embodiments, the insert 140 may have a length greater than or equal to a length of the container body 110. The length of the insert 140 may affect a degree to which the insert is allowed to freely tumble, rotate and/or translate inside the toner bottle system 101 as the toner bottle system 101 rotates. In some embodiments, the length of the insert 140 is about 120 mm to about 200 mm, but depending on the size of the container body 110, the length of the insert 140 may not be so limited. If the insert 140 comprises a coiled wire-form portion, the length of the insert 140 may be determined based on any of the coiled wire-form portion in an un-stretched, stretched, or fully elongated state.

According to various embodiments, a coiled wire-form portion of the insert 140 may have a pitch of about 60 mm to about 100 mm, an unconstrained coil diameter less than an internal cross-sectional diameter of the body section, and a wire diameter of about 1 mm to about 4 mm, but neither the pitch, unconstrained coil diameter, nor the wire diameter of any coiled wire-form portion of the insert 140 may be so limited. In some embodiments, the insert 140 may comprise one or more left-hand wound and/or right-hand wound coiled wire-form portions. In embodiments including multiple inserts 140, the multiple inserts may each be of a same or different type, or combination of types. If any of the multiple inserts 140 comprise one or more coiled wire-form portions, those one or more coiled wire-form portions may have a same or different wind direction, and may individually be any combination of left-hand wound and/or right-hand wound.

In one or more embodiments, the insert 140 may include one or more portions configured to mate, or compliment any channel formed by the helical features 115 and the inner surface of the container body 110. For example, if the insert 140 includes a coiled wire-form portion, the coils of the coiled wire-form portion may be of a same or similar pitch as that of the helical features 115, or if the insert is a brush-type insert, the bristles of the brush may extend into any channels formed by helical features and the inner surface of the container body 110 to agitate the toner as the toner bottle system 101 is rotated. Similarly, the insert 140 may include any combination of any other types of physical features that may be considered to be brush portions, though not themselves embodied as bristles of a brush, that extend from a rod portion or coiled wire-form portion of the insert 140 such as a disk, extending finger, or block comprising one or more of a sponge or solid material, for example, that compliments any channel formed by the helical features 115 and the inner surface of the container body 110. Accordingly, the insert 140 may have the effect of scavenging the toner from the inner walls of the container body 110, such as those formed by any of the inner surface of the container body 110 and the helical features 115, or otherwise disturbing the toner to encourage the toner to collect in the bottom of the container body 110. If toner that would normally remain in the toner bottle system 101 is caused to collect in the bottom of the container body 110, the helical features 115, or other internal auger, for example, may move the toner to the dispensing opening 135 for use in the image forming device.

In other embodiments, however, the insert 140 may include one or more portions, such as those discussed above, configured to conflict with the shape of the channel formed by the helical features 115 and the inner surface of the container body 110. Conflicting portions of the insert 140 may enable one or more portions of the insert 140 to at least partially fall into the channels formed by the helical features 115 as the toner bottle system 101 is rotated to scavenge toner from the inner walls of the container body. Or, conflicting portions of the insert 140 may not fall at all into the channels formed by the helical features 115 and the inner surface of the container body 110 an cause the portion of the toner inside the channels to be indirectly agitated by way of vibration only.

As discussed above, the insert 140 may be constrained by any of the container body 110 and the endcap 120. Alternatively, the toner bottle system 101 may additionally include an insert constraint 150 that is configured to restrict movement of the insert 140 while the toner bottle system 101 rotates until a predetermined amount of toner remains in the toner bottle system 101. The predetermined amount of toner remaining in the toner bottle system 101 may be based, for example, on a determined number of images produced by the image forming device, or on a determined amount of toner expelled from the toner bottle system 101. Once the predetermined amount of toner remains in the toner bottle system 101, then the insert constraint 150 releases the insert 140 to allow the insert 140 to move freely, or at least to an extent that is not otherwise restricted by the insert 140 being constrained via some other means, within the toner bottle system 101 to agitate the toner as the toner bottle system 101 rotates. The insert constraint 150 may be any of a magnet configured to be magnetized and demagnetized on demand or a mechanical constraint configured to hold and release the insert 140 on demand.

In some embodiments, if the insert constraint is a magnet-type constraint, the housing 160 may further include a shield portion 170 configured to restrict a range of a magnetic field associated with the insert constraint 150 to at least an area associated with the insert 140 as the toner bottle system 101 is rotated, for example, to protect various elements of the image forming device from the magnetic field formed by at least the insert constraint 150.

According to various embodiments, the system 100 may further comprise a control module 180 that is itself a processor and a memory, or embodied to communicate with at least one processor and at least one memory including computer program code for one or more programs, the at least one memory and the computer program code configured to, with the at least one processor, cause the insert 140 to be constrained and released on demand to agitate any residual toner that may remain in the toner bottle system 101.

Figure 2:
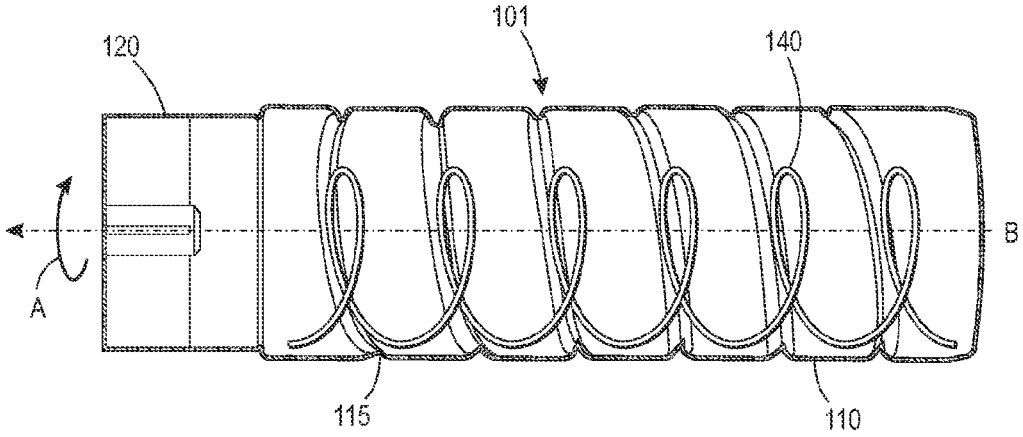
FIG. 2 is cross-sectional side view of a system capable of reducing residual toner in a rotating container having a free moving insert, according to one example embodiment.

FIG. 2 is a cross-sectional side view of a system capable of reducing residual toner in a rotating container having a free moving insert, according to one example embodiment. In this example, the toner bottle system 101 includes the container body 110, the helical features 115 formed on an inner surface of the container body 110, the endcap 120, and the insert 140 illustrated as entirely comprising a coiled wire-form portion. The insert 140 is illustrated as being unconstrained by any surface of the container body 110 or endcap 120. Accordingly, as the toner bottle system 101 is rotated in the direction "A" by an image forming device in which the toner bottle system 101 is installed, the insert 140 may freely tumble within the container body, rotate about the direction "B," and entirely translate in the direction "B."

The insert 140, as discussed above, agitates any toner that is inside the toner bottle system 101 to encourage reducing any residual toner that may otherwise remain inside the toner bottle system 101. Agitating the toner inside the toner bottle system may also facilitate a more predictable and even dispensing of the toner within the toner bottle system 101 into the image forming device as the overall volume of toner inside the toner bottle system 101 decreases over time.

Figure 3:
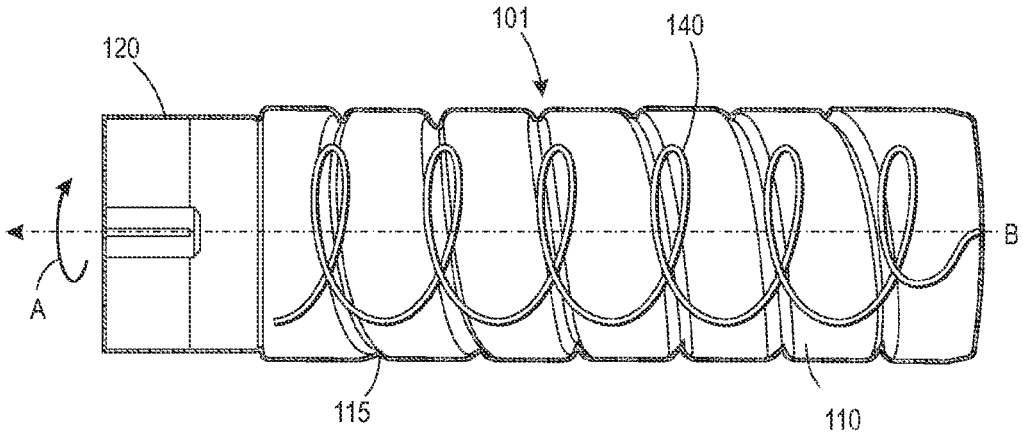
FIG. 3 is a cross-sectional side view of a system capable of reducing residual toner in a rotating container having an insert constrained on at least one end, according to one example embodiment.

FIG. 3 is a cross-sectional side view of a system capable of reducing residual toner in a rotating container having an insert that is constrained on at least one end, according to one example embodiment. In this example, the toner bottle system 101 includes the container body 110, the helical features 115 formed on an inner surface of the container body 110, the endcap 120, and the insert 140 illustrated as entirely comprising a coiled wire-form portion.

The insert 140 is illustrated as being constrained by an end of the container body 110 that is opposite the endcap 120. In this example, the toner bottle system 101 is rotated in the direction "A" by an image forming device in which the toner bottle system 101 is installed, The insert 140 may tumble within the container body, rotate about the direction "B," and translate in the direction "B" to an extent allowed by various factors such as, but not limited to, the insert 140 being constrained by the container body 110, particular dimension and/or materials of the insert (i.e., factors contributing to a spring constant or general flexibility of the insert 140, and the like. For example, if the insert 140 is constrained by one end of the container body 110, the remainder of the insert 140 may flip, flop, wind, unwind, etc. as the toner bottle system 101 rotates in the direction "A." In this example, the free end of the insert 140 and any portion of the insert 140 between the free end of the insert 140 and the constrained end of the insert 140 may translate in the direction "B."

In should be noted that, in other embodiments, the insert 140 may be constrained on both ends, for example by the container body 110 on one end and by the endcap 120 or the container body 110 on the other end. If constrained on two ends, the insert 140 may similarly tumble, rotate, and translate as discussed in the above example, but the insert 140 simple does not have a free end and any amount that the insert 140 translates in the direction "B" is limited to a translation amount that occurs between the two constrained ends of the insert 140.

Regardless of arrangement, the insert 140, as discussed above, agitates any toner that is inside the toner bottle system 101 to encourage reducing any residual toner that may otherwise remain inside the toner bottle system 101 and facilitate a more predictable and even dispensing of the toner within the toner bottle system 101 into the image forming device as the overall volume of toner inside the toner bottle system 101 decreases over time.

Figure 4:
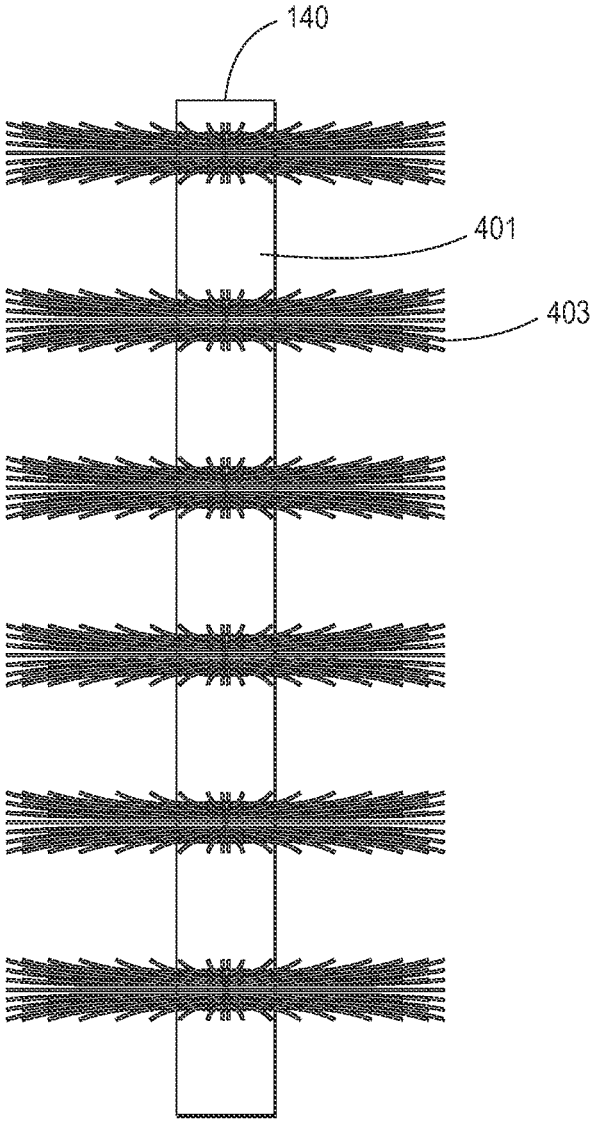
FIG. 4 is an illustration of an insert that is a brush-type insert, according to one example embodiment.

FIG. 4 is an illustration of a brush-type insert, according to one example embodiment. In this example, the insert 140 includes a rod-portion 401 and a plurality of brush portions 403. The rod-portion 401 may be any length that can be accommodated by the container body 110 and endcap 120 when assembled. The brush portions 403 may be any number or arrangement along a length of the rod-portion 401. In some embodiments, the brush-portions 403 may include sectioned portions as illustrated that are configured to cooperate with any channels formed by the helical features 115 and the inner surface of the container body 110, discussed above, to agitate the toner within the toner bottle system 101. Alternatively, the brush portions 403 may entirely cover the rod-portion 401, and/or be configured to conflict with any channels formed by the helical features 115 and the inner surface of the container body 110. In some embodiments, the brush portions 403 may include any combination of bristles, solid materials, or sponge materials, for example, configured to cooperate with the helical features 115 and the inner surface of the container body 110 to agitate any residual toner inside the toner bottle system as the toner bottle system 101 rotates in the direction "A." It should be noted that while the example brush-type insert 140 has what appears to be a single-component straight rod-portion 401, the discussed rod-portion 401 may take any form comprising any singular or multi-component arrangement. Additionally, the rod-portion 401, regardless of whether it is a single or multi-component feature, may be any combination of a straight/rigid form, a straight/flexible form, a curved form, a rod having at least one portion and at least one other portion stemming at an angle other than 180 degrees from the at least one portion, a stepped-type form that varies along a length of the rod-portion 401, a coiled-form having brush portions 403, etc.

Figure 5A:
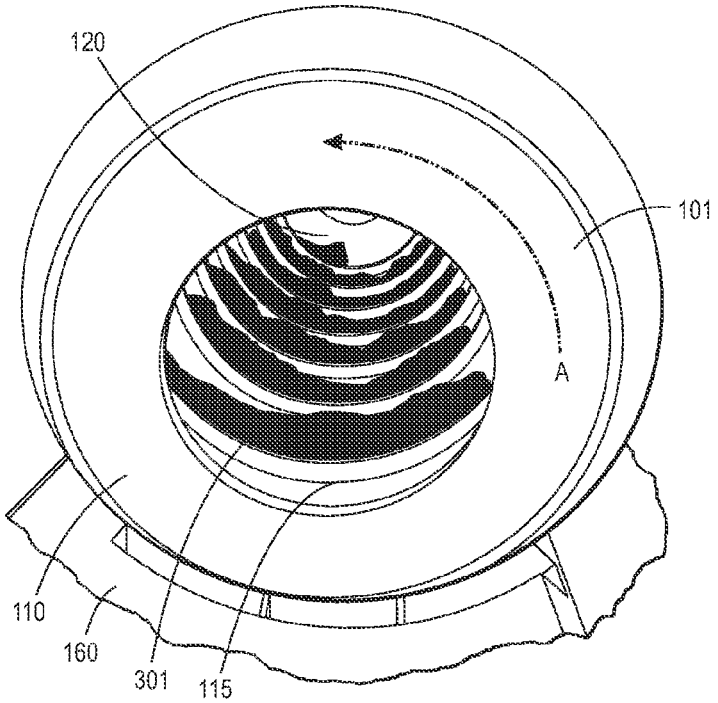
FIG. 5*a* is a diagram illustrating the effect of not agitating any toner contained in a system capable of reducing residual toner, according to one example embodiment.
Figure 5B:
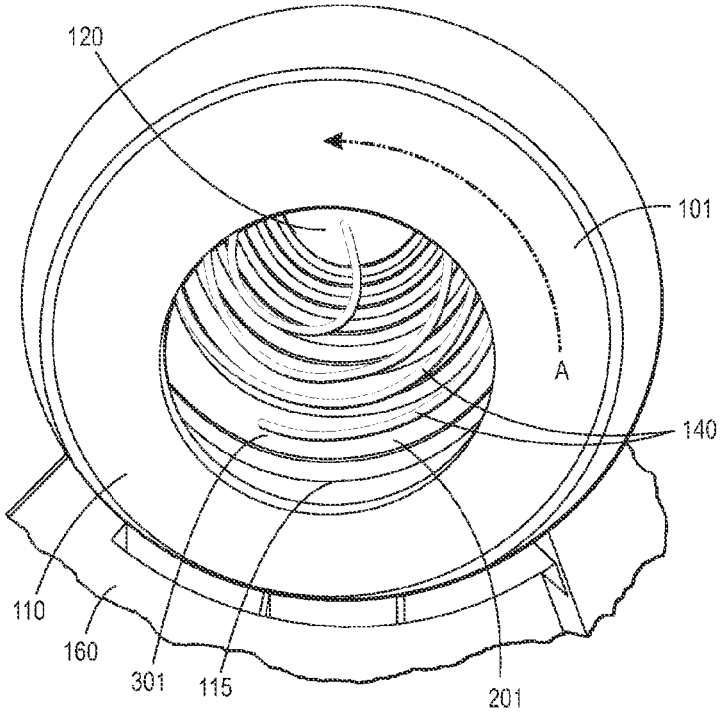
FIG. 5*b* is a diagram illustrating the effect of agitating at least a portion of the toner contained in a system capable of reducing residual toner, according to one example embodiment.

FIGS. 5*a* and 5*b* illustrate the effects agitating toner with an insert has on reducing residual toner in a rotating container, according to one example embodiment.

FIG. 5*a* illustrates a perspective view from an end portion of the container body 110 facing the direction "B," discussed above, toward the endcap 120. In this example, the toner 501 inside the toner bottle system 101 was not agitated by an insert 140. The toner bottle system 101 is illustrated as lacking the insert 140 for clarity. Accordingly, while the toner 501 is driven toward the dispensing end of the toner bottle system 101, some residual toner 501 remains attached to the helical features 115 and any inner surfaces of the container body 110 within channels formed by the helical features 115 and the inner surface of the container body 110. A similar result might occur if the toner bottle system 101 included the insert constraint 150 and did not allow the insert 140 to agitate the toner 501.

FIG. 5*b* illustrates a perspective view from the same end portion of the container body 110 facing the direction "B" toward the endcap 120 as shown in FIG. 5*a*. In this example, however, the toner bottle system 101 includes an insert 140 that was allowed to agitate the toner 501. As such, the insert 140 causes the residual toner 501 to be agitated such that the residual toner 501 separates from the helical features 115 and the inner surfaces of the container body 110 so that the residual toner 501 can be driven by the helical features 115 toward the endcap 120 for dispensing into the image forming device.

According to this example, if the insert 140 were not present as illustrated in FIG. 5*a*, or constrained such that the insert 140 is not allowed to agitate the toner 501, approximately 125 grams of residual toner 501 would have been wasted, which is equivalent to approximately 3000 printed sheets of a substrate. But, because the toner bottle system 101 includes the insert 140 and that insert 140 was allowed to agitate the toner 501, as shown in FIG. 5*b*, *a* majority of the residual toner 501, if not all of the residual toner 501, is able to be recovered by the system 100 thereby maximizing the life expectancy of the toner bottle system 101 and reducing waste. It should be noted, however, that this reduction in residual toner 501 and waste is merely an example to illustrate the effectiveness of agitating toner with the insert 140 in the toner bottle system 101 and the system 100 as a whole. The performance of the system 100 should not be considered to be limited to the above-discussed quantities relating to residual toner recovery and waste reduction performance.

Figure 6A:
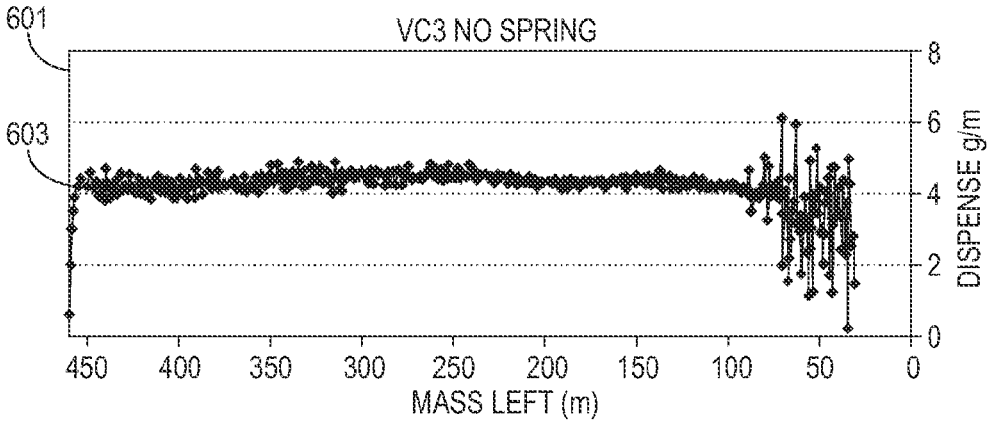
FIG. 6*a* is a chart illustrating a rate at which toner is dispensed by a rotating container without agitating the toner as the container rotates, according to one example embodiment.
Figure 6B:
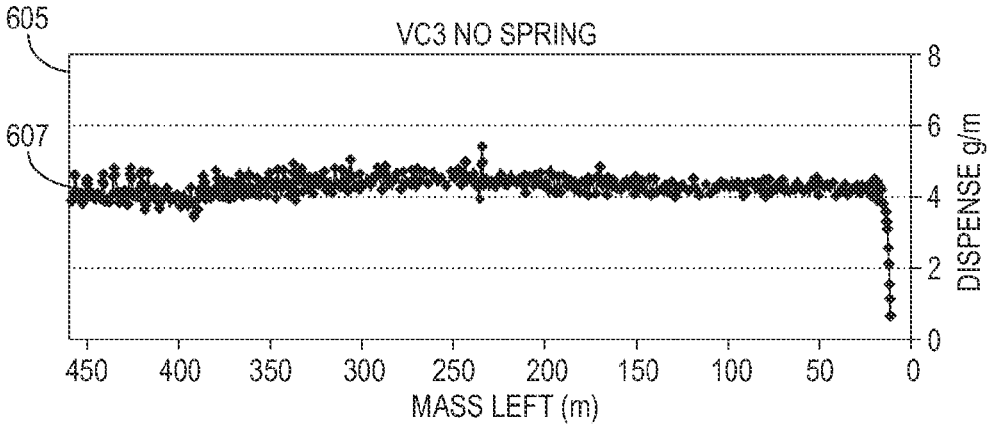
FIG. 6*b* is a chart illustrating the effect agitating at least a portion of the toner has on reducing residual toner in a rotating container, according to one example embodiment.

FIGS. 6*a* and 6*b* are charts illustrating the effect agitating residual toner with an insert has on reducing residual toner in a rotating container. FIGS. 6*a* and 6*b* are test cases in which toner is fed from a toner bottle system, such as that discussed above. The test cases measured the amount of toner in grams that was dispensed by the toner bottle system as the mass of the toner remaining in the toner bottle system decreased.

FIG. 6*a* illustrates an example test case 601 in which the toner in the toner bottle system is not agitated by an insert, whether it be because the insert is not present within the toner bottle system 100, or because the insert is constrained and not allowed to agitate the toner in the bottle system 100. In this example, the amount of toner dispensed by the toner bottle system as the remaining mass of toner inside the toner bottle system decreases is illustrated by plot 603. Plot 603 shows that as the mass of toner in the system decreases from about 450 grams to about 100 grams, the amount of toner that is dispensed by the toner bottle system is relatively consistent and is about 4 grams. But, after the toner bottle system has less than about 100 grams remaining, then the amount of toner dispensed by the toner bottle system becomes randomized which illustrates that the performance of the toner bottle system is not optimal and the image forming device may determine that the toner bottle system is "empty." Print quality of the image forming device may also be noticeably reduced in this case even though the toner bottle system still has a usable amount of toner available inside it.

FIG. 6*b* illustrates an example test case 605 in which the toner in the toner bottle system is agitated by an insert. In this example, the amount of toner dispensed by the toner bottle system as the remaining mass of toner inside the toner bottle system decreases is illustrated by plot 607. Plot 607 shows that as the mass of toner in the system decreases from about 450 grams to about 10 grams, the amount of toner that is dispensed by the toner bottle system is relatively consistent and is about 4 grams. But, after the toner bottle system has less than about 10 grams remaining, the amount of toner dispensed by the toner bottle system significantly drops toward 0 grams. This test illustrates that the performance of the toner bottle system is optimal almost until the toner bottle system is entirely empty. Accordingly, a lesser amount of, if any, residual toner remains in the toner bottle system as compared to a toner bottle system in which the toner inside the toner bottle system is not agitated. If the toner bottle system 101 includes an insert such as that described above, the life expectancy of the toner bottle system that agitates its toner is longer than a toner bottle system that does not. As such, the image forming device may not determine that the toner bottle system is "empty" and/or print quality of the image forming device may not be noticeably reduced until the toner bottle system has close to 0 grams of residual toner remaining inside it.

Figure 7:
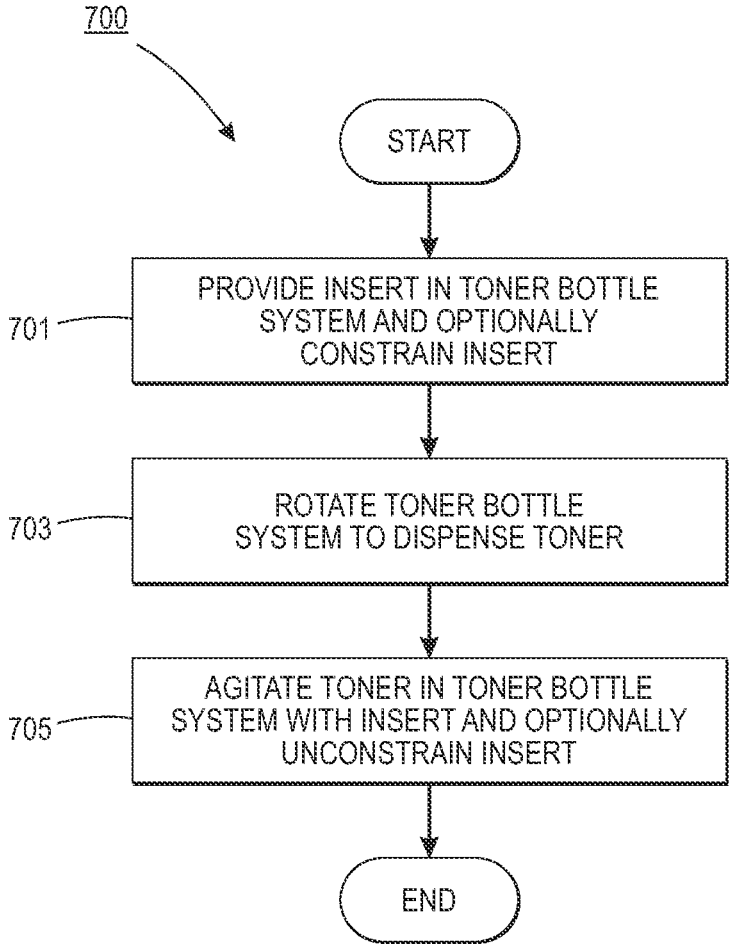
FIG. 7 is a flowchart of a process for reducing residual toner in a rotating container, according to one embodiment.

FIG. 7 is a flowchart of a process 700 for reducing residual toner in a rotating container, according to one embodiment. In step 701, an insert is provided and included in a toner bottle system. The insert may be optionally constrained to restrict movement of the insert within the toner bottle system to a particular amount, or entirely until a predetermined time at which the insert may be unconstrained. Then, in step 703, the toner bottle system is caused to rotate to dispense toner that is contained by the toner bottle system. The toner bottle system, in this example, includes a container body, an endcap, helical features formed on an internal surface of at least the container body, and the insert. The insert is at least capable of tumbling and rotating within a space constrained by the container body and the endcap as the toner bottle system is rotated. Next, in step 705, the insert agitates at least any residual toner that would normally be left attached to any helical features or internal surface of the container body after a majority of the toner inside the toner bottle system is transported by the helical features to a dispensing end of the toner bottle system and into an image forming device. The insert may optionally be unconstrained in step 705 to facilitate agitation of the toner contained by the toner bottle system.

The processes described herein for reducing residual toner in a rotating container may be advantageously implemented via software, hardware, firmware or a combination of software and/or firmware and/or hardware. For example, the processes described herein, may be advantageously implemented via processor(s), a Digital Signal Processing (DSP) chip, an Application Specific Integrated Circuit (ASIC), Field Programmable Gate Arrays (FPGAs), etc.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can include one or more of dynamic memory (e.g., RAM, magnetic disk, writable optical disk, flash card, etc.) and static memory (e.g., ROM, CD-ROM, etc.) for storing executable instructions or data structures that when executed perform the steps described herein to reduce residual toner in a rotating container.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps discussed above may be executed in any reasonable order to effect the objectives of the disclosed embodiments. No particular order to the disclosed steps of the disclosed method is necessarily implied any discussion or depiction, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

What is claimed is:

1. An apparatus useful in printing comprising:

a rotatable vessel configured to contain a toner, the rotatable vessel comprising a body section having a substantially round cross-section, a first end at one axial end of the body section, a second end axially distal the first end, and helical features on an internal surface of the body section configured to transport at least a portion of the toner in an axial direction between the first end and the second end as the rotatable vessel is rotated; and an insert configured to tumble and rotate within an inside portion of the rotatable vessel and agitate the toner as the rotatable vessel rotates, the insert comprising a coiled wire-form portion that comprises a right-hand wound portion, wherein the insert has a length greater than a distance between the first end of the body section and the second end of the body section.

2. The apparatus of claim 1, wherein the insert is constrained by at least one of the first end and the second end.

3. The apparatus of claim 1, wherein the rotatable vessel is configured to be rotated about the axial direction, and the coiled wire-form portion is wound in a direction that corresponds with the direction of rotation of the rotatable vessel.

4. The apparatus of claim 1, wherein the coiled wire-form portion comprises a left-hand wound portion.

5. The apparatus of claim 1, wherein the insert further comprises another coiled wire-form portion that comprises a left-hand wound portion.

6. The apparatus of claim 1, wherein the coiled wire-form portion has a pitch that corresponds to the helical features to enable the coiled wire-form portion to mate with one or more channels formed by the helical features and the internal surface of the body section.

7. A method useful in printing comprising:

causing, at least in part, a rotatable vessel configured to contain a toner to rotate about an axis, the vessel comprising a body section having a substantially round cross-section, a first end at one axial end of the body section, a second end axially distal the first end, and helical features on an internal surface of the body section configured to transport the toner in an axial direction between the first end and the second end as the vessel is rotated; and causing, at least in part, at least a portion of the toner to be agitated by an insert configured to tumble and rotate within an inside portion of the rotatable vessel as the rotatable vessel rotates, the insert comprising a coiled wire-form portion that comprises a right-hand wound portion, wherein the insert has a length greater than a distance between the first end of the body section and the second end of the body section.

8. The method of claim 7, wherein the insert is constrained by at least one of the first end and the second end.

9. The method of claim 7, wherein the rotatable vessel is configured to be rotated about the axial direction, and the coiled wire-form portion is wound in a direction that corresponds with the direction of rotation of the rotatable vessel.

10. The method of claim 7, wherein the coiled wire-form portion comprises a left-hand wound portion.

11. The method of claim 7, wherein the insert further comprises another coiled wire-form portion that comprises a left-hand wound portion.

12. The method of claim 7, wherein the coiled wire-form portion has a pitch that corresponds to the helical features to enable the coiled wire-form portion to mate with one or more channels formed by the helical features and the internal surface of the body section.

13. An image forming device comprising:

an image marking device; and at least one rotating toner delivery container, the at least one rotating toner deliver container comprising:

a rotatable vessel configured to contain a toner, the rotatable vessel comprising a body section having a substantially round cross-section, a first end at one axial end of the body section, a second end axially distal the first end, and helical features on an internal surface of the body section configured to transport at least a portion of the toner in an axial direction into the image marking device, the axial direction being between the first end and the second end as the rotatable vessel is rotated; and an insert configured to tumble and rotate within an inside portion of the rotatable vessel and agitate the toner as the rotatable vessel rotates, wherein the insert comprises a coiled wire-form portion having a pitch that corresponds to the helical features to enable the coiled wire-form portion to mate with one or more channels formed by the helical features and the internal surface of the body section.

14. A method of filling a container with a toner material useful in printing, the method comprising:

providing a vessel configured to contain a toner, the vessel comprising a body section having a substantially round cross-section, a first end at one axial end of the body section, a second end axially distal the first end, and helical features on an internal surface of the body section, the helical features being configured to transport the toner in an axial direction between the first end and the second end as the vessel is rotated by an image forming device;

causing, at least in part, the vessel to be filled with the toner; and causing, at least in part, an insert configured to agitate at least a portion of the toner to be input into the vessel, the insert being configured to tumble and rotate within an inside portion of the vessel as the vessel is rotated by the image forming device, wherein the insert comprises a coiled wire-form portion having a pitch that corresponds to the helical features to enable the coiled wire-form portion to mate with one or more channels formed by the helical features and the internal surface of the body section.

* * * * *